US008939339B2

(12) United States Patent
Vanstaan et al.

(10) Patent No.: US 8,939,339 B2
(45) **Date of Patent: *Jan. 27, 2015**

(54) INTERFACE FOR FUEL DELIVERY SYSTEM FOR COMBUSTION NAILER

(75) Inventors: Valery H. Vanstaan, Highland Park, IL (US); Maureen Louise Shea, Wilmette, IL (US); Marc Largo, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 501 days.

This patent is subject to a terminal disclaimer.

(21) Appl. No.: 13/271,995

(22) Filed: Oct. 12, 2011

(65) Prior Publication Data

US 2012/0267417 A1 Oct. 25, 2012

Related U.S. Application Data

(63) Continuation-in-part of application No. 12/759,340, filed on Apr. 13, 2010, now Pat. No. 8,302,831.

(51) Int. Cl.
*B25C 1/08* (2006.01)

(52) U.S. Cl.
CPC ..... *B25C 1/08* (2013.01)
USPC ..... 227/9; 227/10

(58) Field of Classification Search
USPC ..... 227/9, 10
See application file for complete search history.

(56) References Cited

U.S. PATENT DOCUMENTS

| | | | |
|---|---|---|---|
| 3,035,617 | A | 5/1962 | Breitenstein |
| 4,403,722 | A | 9/1983 | Nikolich |
| 4,483,473 | A | 11/1984 | Wagdy |
| 4,483,474 | A | 11/1984 | Nikolich |
| 4,522,162 | A | 6/1985 | Nikolich |
| 5,115,944 | A | 5/1992 | Nikolich |
| 5,263,439 | A | 11/1993 | Doherty et al. |
| 5,484,088 | A | 1/1996 | Martin |
| 6,145,724 | A | 11/2000 | Shkolnikov et al. |
| 6,302,297 | B1 | 10/2001 | Richardson et al. |
| 6,679,414 | B2 | 1/2004 | Rotharmel |
| 6,796,478 | B2 | 9/2004 | Shkolnikov et al. |
| 7,296,719 | B1 | 11/2007 | Taylor et al. |
| 7,392,922 | B2 | 7/2008 | Vanstaan et al. |
| 7,445,136 | B2 | 11/2008 | Lin |
| 7,478,740 | B2 | 1/2009 | Shea |
| 7,546,938 | B2 | 6/2009 | Panasik et al. |

(Continued)

FOREIGN PATENT DOCUMENTS

| | | |
|---|---|---|
| DE | 2002043547 | 9/2010 |

*Primary Examiner* — Thanh Truong
*Assistant Examiner* — Tara M Ho
(74) *Attorney, Agent, or Firm* — Greer, Burns & Crain, Ltd.; Maurice E. Finnegan, III

(57) ABSTRACT

A fuel delivery system for use with a combustion nailer including a cylinder head frame, the delivery system includes a fuel cell with an outer shell having a closed lower end and an open upper end, a closure crimped over the upper end and defining an opening for accommodating a reciprocating valve stem, a fuel cell adapter frictionally engaging the closure and including a flange configured for suspending the fuel cell in the fuel cell chamber. A stem receiver block is connectable to the cylinder head frame and includes a stem engagement portion configured for directly and sealingly engaging an end of the valve stem, the stem engagement portion being in fluid communication with an internal receiver passage constructed and arranged for delivering fuel to the combustion chamber.

15 Claims, 6 Drawing Sheets

(56) References Cited

U.S. PATENT DOCUMENTS

| | | | |
|---|---|---|---|
| 7,571,841 | B2 | 8/2009 | Gibson et al. |
| 7,591,249 | B2 | 9/2009 | Wagdy et al. |
| 7,654,429 | B2 | 2/2010 | Shea |
| 7,661,568 | B2 | 2/2010 | Vanstaan et al. |
| 7,841,499 | B2 | 11/2010 | Ho |
| 7,841,500 | B2 | 11/2010 | Ho |
| 2002/0043547 | A1 | 4/2002 | Shkolnikov et al. |
| 2003/0127488 | A1 | 7/2003 | Wagdy |
| 2005/0000711 | A1 * | 1/2005 | Hurlstone et al. ..... 173/19 |
| 2006/0186166 | A1 | 8/2006 | Akiba |
| 2007/0246571 | A1 | 10/2007 | Marion et al. |
| 2008/0000451 | A1 | 1/2008 | Shea et al. |
| 2008/0110953 | A1 | 5/2008 | Gibson et al. |
| 2009/0001120 | A1 | 1/2009 | Shea et al. |
| 2010/0096429 | A1 | 4/2010 | Ho |

* cited by examiner

INTERFACE FOR FUEL DELIVERY SYSTEM FOR COMBUSTION NAILER

RELATED APPLICATION

This application is a Continuation-in-Part of U.S. patent application Ser. No. 12/759,340 filed Apr. 13, 2010.

BACKGROUND

The present invention relates generally to improvements in fuel cell fuel delivery arrangements for use in combustion tools, and more specifically to adapters provided to combustion tool fuel cells for obtaining more consistent fuel dosing.

In the present application the term "combustion nailer" refers to combustion powered fastener driving tools, also known as combustion tools, cordless framing tools, cordless trim tools and the like. More particularly, the present invention relates to improvements in the delivery of fuel from fuel cells customarily provided for such purposes.

Such tools typically have a housing substantially enclosing a combustion power source, a fuel cell, a battery, a trigger mechanism and a magazine storing a supply of fasteners for sequential driving. The power source includes a reciprocating driver blade which separates a forward most fastener from the magazine and drives it through a nosepiece into the workpiece. Exemplary tools are described in U.S. Pat. Nos. 4,483,473; 4,522,162; 6,145,724; and 6,679,414, all of which are incorporated by reference. Such fastener-driving tools and such fuel cells are available commercially from ITW-Paslode (a division of Illinois Tool Works, Inc.) of Vernon Hills, Ill., under its IMPULSE trademark.

As exemplified in Nikolich U.S. Pat. Nos. 4,403,722; 4,483,474; and 5,115,944, all of which are also incorporated by reference, it is known to use a dispenser such as a fuel cell to dispense a hydrocarbon fuel to a combustion tool. A design criterion of such fuel cells is that only a desired amount of fuel or dose of fuel should be emitted by the fuel cell for each combustion event. The amount of fuel should be carefully monitored to provide the desired combustion, yet in a fuel-efficient manner to prolong the working life of the fuel cell.

Prior attempts to address this dosage factor have resulted in fuel metering valves located in the tool (U.S. Pat. No. 5,263,439) or attached to the fuel cell (U.S. Pat. No. 6,302,297), both of which are also incorporated by reference. Fuel cells have been introduced having internal metering valves, as disclosed in U.S. Pat. No. 7,392,922, also incorporated by reference. Other combustion tool fuel delivery arrangements are disclosed in U.S. Pat. Nos. 7,478,740; 7,571,841; 7,591,249; 7,654,429; and 7,661,568, also incorporated by reference.

Regardless of the location of the metering valve, the associated combustion nailer is designed to exert a force on the valve, either the reciprocating valve stem or on the valve body itself, to cause the stem to retract against a biasing force in the metering valve to dispense a measured dose of fuel. It is important for fuel economy in the fuel cell, and for desired operation of the combustion nailer, that only the designated amount of fuel to be supplied to the tool on a dosage basis.

Designers of such tools are focused on maintaining a sealed relationship in the fuel delivery system for more efficiently using fuel in the fuel cells, and in particular when the tool is used at relatively cooler ambient temperatures (below about 50° F., 10° C.). Another drawback of conventional systems is that when the fuel cell stem is provided with an adapter extension, in some cases the fuel cell stem is exposed to external accidental contacts. Such external accidental contacts may unintentionally dispense fuel, or damage or even break the fuel stem, leaving the fuel cell unusable.

SUMMARY

To more accurately maintain the relationship between the fuel cell metering valve stem and the corresponding actuation mechanism on the tool, the current fuel system includes two elements: a fuel cell stem receiver block directly in contact with the fuel cell stem, and a fuel cell adapter which securely engages an upper peripheral ring of the fuel cell. A direct connection between the stem receiver block and the fuel cell stem reduces the chances for fuel leakage and also reduces the number of components of the fuel delivery system, since a separate fuel stem adapter is no longer needed.

Further, a vertically projecting, generally tubular cowl-like collar projects vertically from an upper surface of the fuel cell adapter and protects the fuel cell stem from accidental contact which might damage the stem's sealing surface, or more seriously, may damage the stem itself. Another advantage of the collar is that it cooperates with, and accommodates reciprocal movement of the stem receiver block in defining a vertical stroke track for the guiding the block during the fuel dispensing process. Unlike previous stem receiver blocks made of plastic, the present block is made of metal, preferably aluminum, which, when properly configured, has been found to enhance tool performance at lower temperatures, and also enhances the sealing relationship between the block and the fuel cell stem.

It has been found that the metal stem receiver block allows for increased vaporization/reduced condensation of the fuel. This is important at lower ambient temperatures when flexible fuel transport apparatus are used. In the case of conventional plastic stem receiver blocks, the plastic typically has low thermal conductivity and a relatively low thermal mass. If enough fuel is allowed to vaporize in the stem receiver block, the block can present a cold zone. If the cold zone becomes too cold, fuel flow is limited, inhibiting tool performance.

Another feature of the present system is that the fuel cell has a fuel cell adapter with a relatively large diameter flange. The flange engages arms on the cylinder head, and thus the fuel cell is suspended from the cylinder head, rather than resting on a floor in the fuel cell chamber of the tool housing. This suspension of the fuel cell results in a more consistent relationship between the fuel cell and the corresponding tool actuator mechanism.

More specifically, a fuel delivery system is provided for use with a combustion nailer including a cylinder head frame. The delivery system includes a fuel cell with an outer shell having a closed lower end and an open upper end, a closure crimped over the upper end and defining an opening for accommodating a reciprocating valve stem, a fuel cell adapter frictionally engaging the closure and including a flange configured for suspending the fuel cell in the fuel cell chamber. A stem receiver block is connectable to the cylinder head frame and includes a stem engagement portion configured for directly and sealingly engaging an end of the valve stem, the stem engagement portion being in fluid communication with an internal receiver passage constructed and arranged for delivering fuel to the combustion chamber.

DETAILED DESCRIPTION

Figure 1:
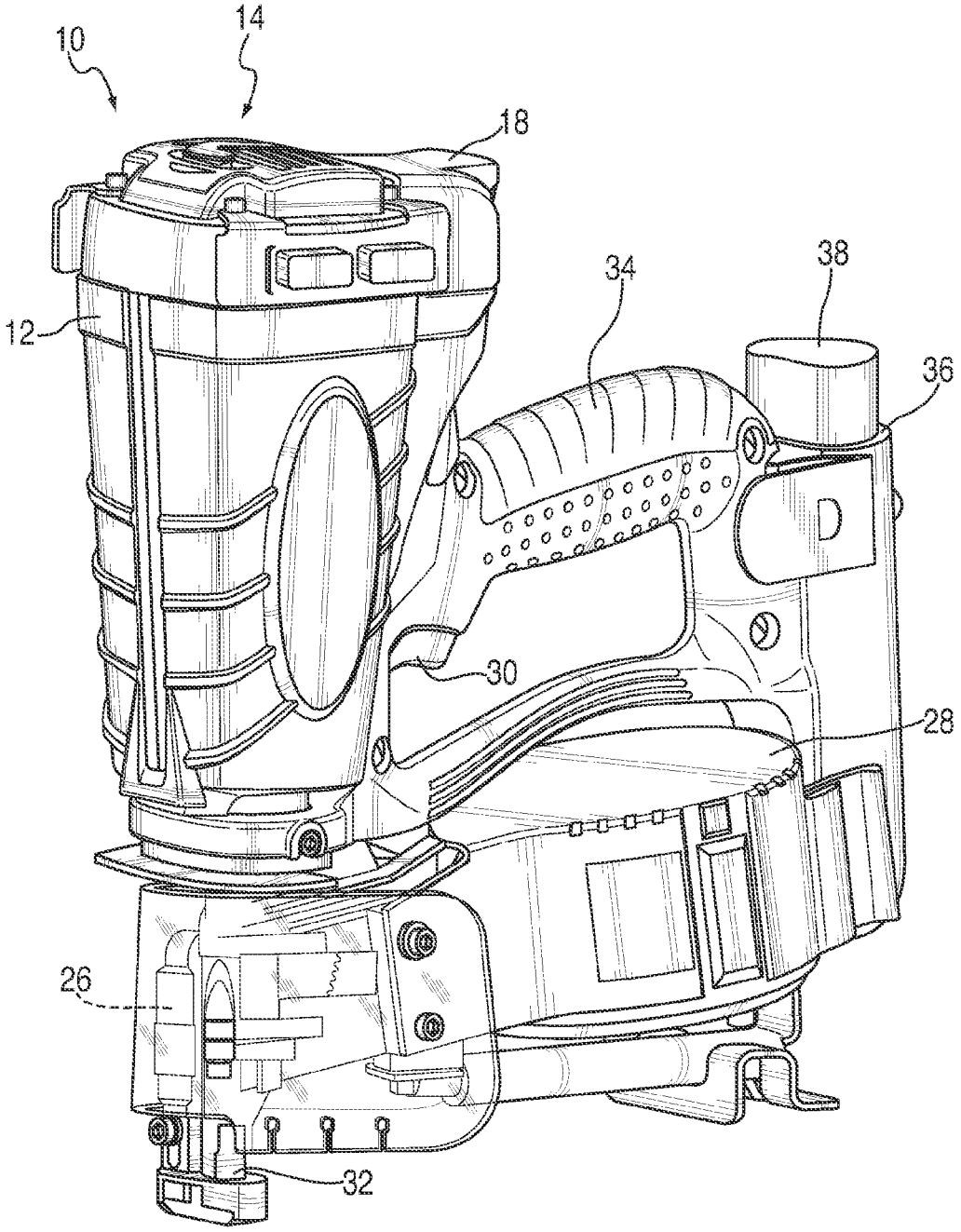
FIG. 1 is a front perspective view of a combustion tool equipped with the present fuel delivery system.
Figure 2:
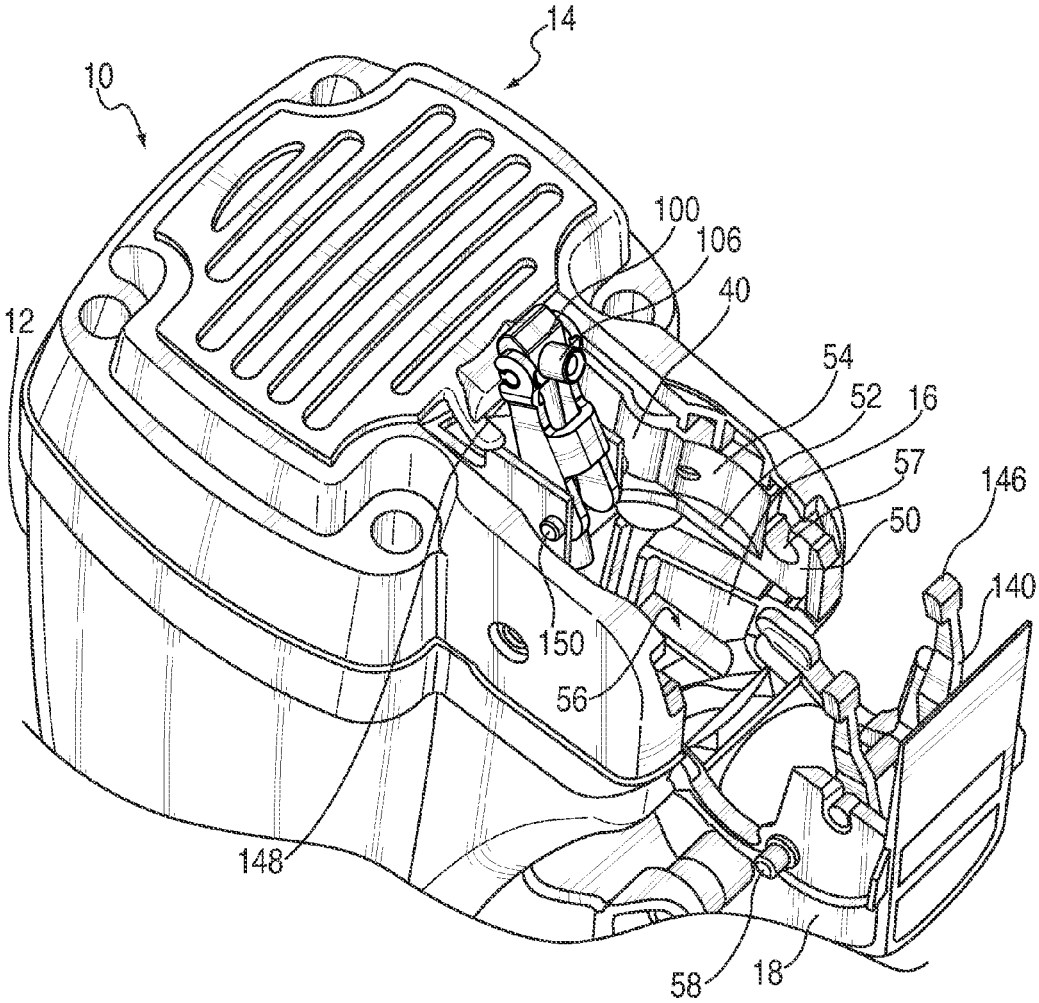
FIG. 2 is a fragmentary top perspective view of the tool of FIG. 1 showing an upper end of the fuel cell chamber open and ready for accommodating a fuel cell.
Figure 3:
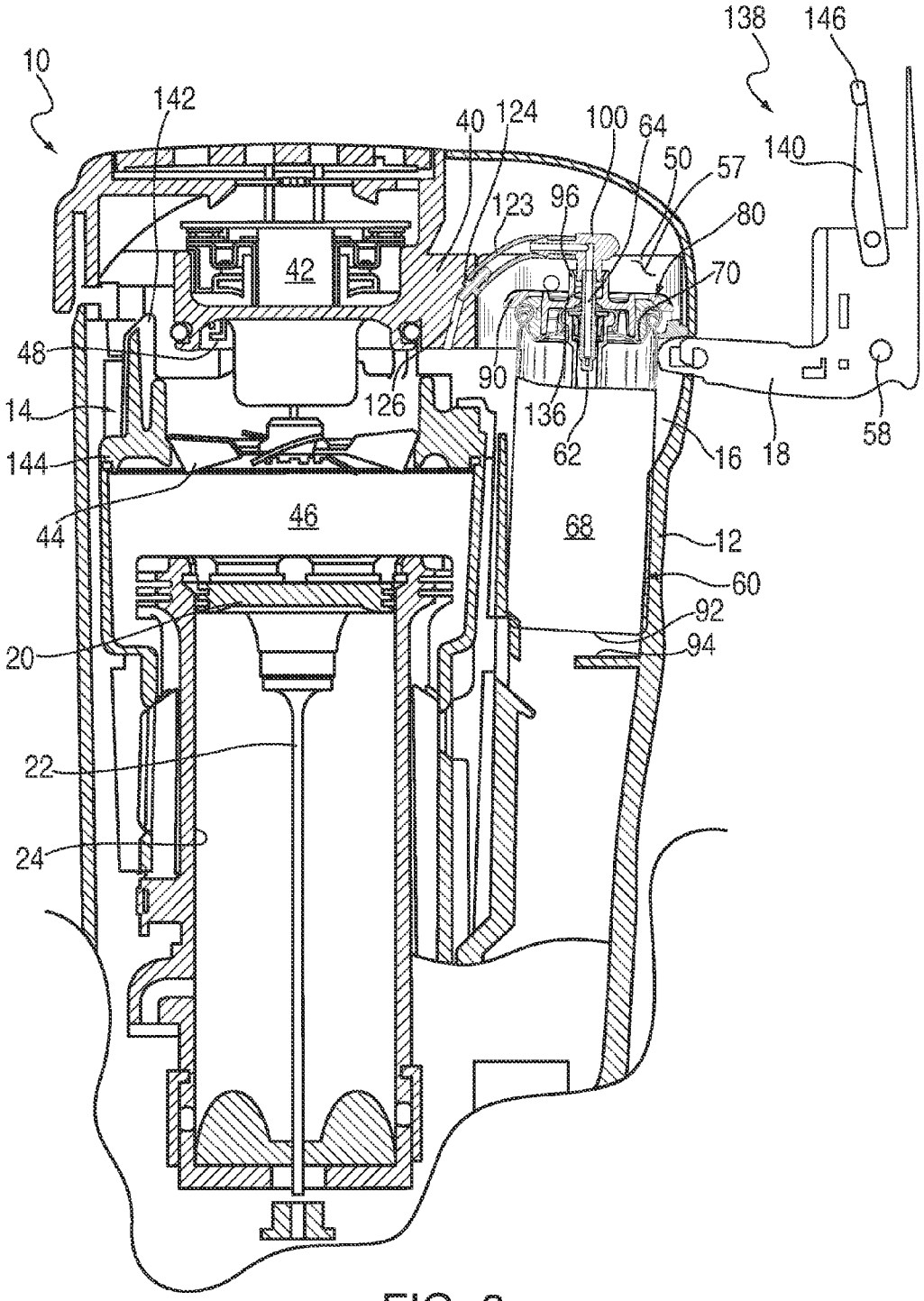
FIG. 3 is a fragmentary vertical section of the tool of FIG. 1 showing the present fuel delivery system.

Referring now to FIGS. 1-3, a combustion nailer is depicted, generally designated 10. As is known in the art, a main tool housing 12 encloses a power source or engine 14 (FIG. 3) and a fuel cell chamber 16. A fuel cell door 18 is pivotally engaged on the housing 12 and is configured to close off the fuel cell chamber 16 during tool operation. The construction and arrangement of such doors 18 is well known in the art.

The power source 14 includes a reciprocating piston 20 (FIG. 3) having a driver blade 22 secured thereto for common movement relative to the power source and within a cylinder 24. A nosepiece 26 (FIG. 1) is secured to a lower end of the power source 14 as is known in the art and provides an attachment point for a fastener magazine 28, here shown as a coil magazine, however other types of magazines such as strip magazines are considered suitable. Fasteners are fed sequentially from the magazine 28 into the nosepiece 26 where they are engaged by the driver blade 22 traveling down a fastener passageway in the nosepiece.

The fasteners are driven into a workpiece or substrate after initiation of a power cycle, initiated in some tools by the operator actuating a trigger 30. A workpiece contact element 32 reciprocates relative to the nosepiece 26 to control tool functions as is known in the art, but is not relevant to the present discussion.

Also provided to the housing 12 is a handle 34 which serves as the mounting point for the trigger 30. A battery chamber 36 (FIG. 1) is also provided to the housing 12 for accommodating at least one battery 38 for powering electronic tool functions such as spark generation, cooling fan operation, electronic fuel injection and/or tool condition sensing as known in the art. The location of the battery chamber 36 may vary depending on the particular nailer configuration.

Figure 4:
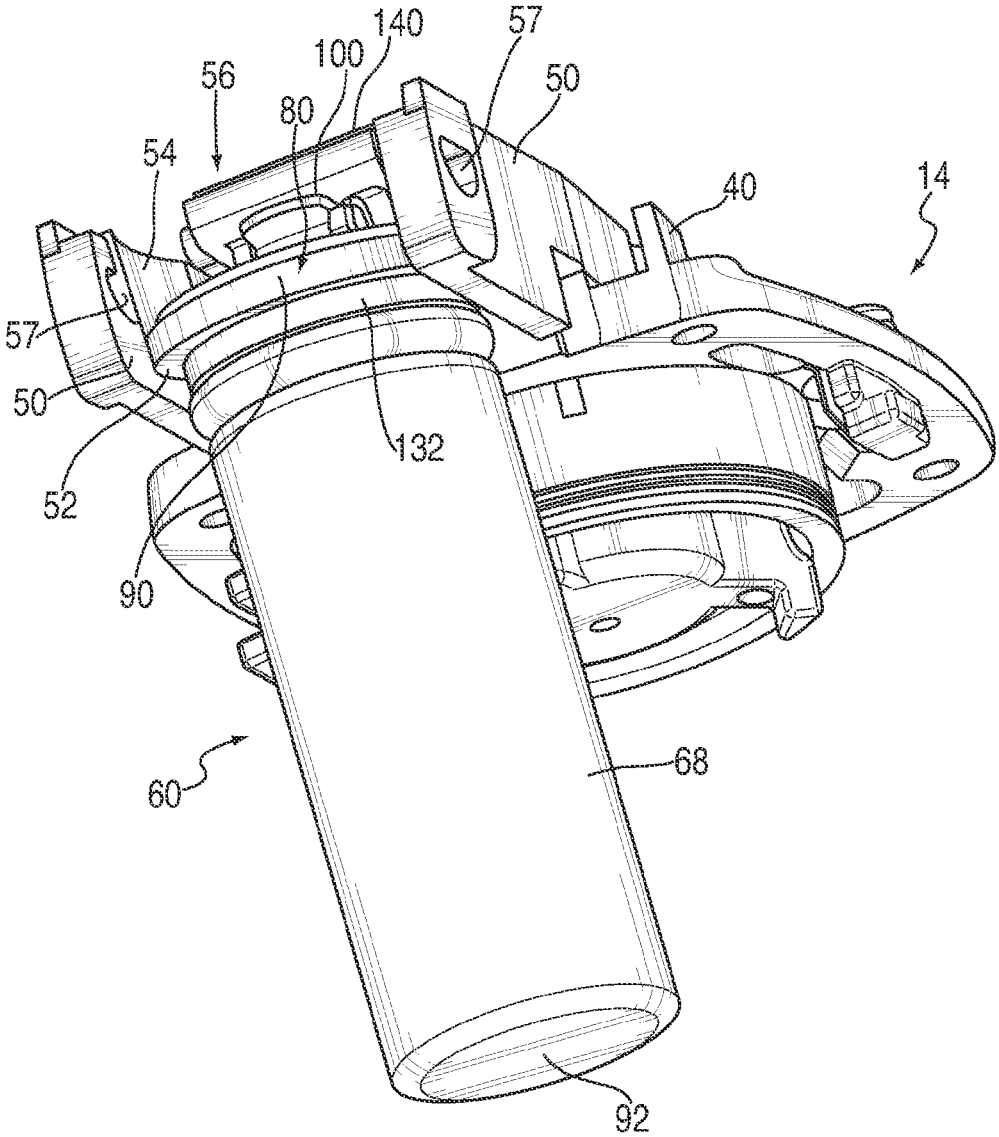
FIG. 4 is a fragmentary bottom perspective view of a fuel cell shown suspended from the cylinder head frame.

Referring now to FIGS. 2-4, an upper end of the power source 14 is defined by a cylinder head 40, serving as the mounting point for a fan motor 42 powering a fan 44 projecting into a combustion chamber 46, and also being the mounting point for a spark generator or spark plug 48. Also included on the cylinder head 40 are two spaced, parallel arms 50 included as part of a cylinder head frame, each having a recessed shelf 52 defined on an inner surface 54 (FIG. 2). A space 56 between the inner surfaces 54 defines an entrance to the fuel cell chamber 16. The entrance 56 is considered part of the fuel cell chamber 16. Ends of the arms 50 have pivot openings 57 for receiving corresponding lugs 58 of the fuel cell door 18.

Referring now to FIGS. 3-6, as described in U.S. Pat. No. 5,263,439, incorporated by reference, inserted into the fuel cell chamber 16 is a fuel cell, generally designated 60, the general construction of which is well known in the art pertaining to combustion tools, and which is configured for removable engagement in the fuel cell chamber 16. The particular construction of the present fuel cell 60, having an internal fuel metering valve 62 (FIGS. 3 and 6) is described in copending U.S. Pat. No. 7,392,922 which has been incorporated by reference. Generally speaking, a fuel valve stem 64 is biased to a closed position, as by a spring (not shown), but when axially depressed, a measured dose of fuel is dispensed. Upon withdrawal of the axial force, the stem 64 resumes its rest position, and a subsequent dose of fuel flows into a metering chamber 66 for the next firing cycle.

Other major components of the fuel cell 60 include a generally cylindrical, close bottomed outer shell 68, and a closure 70 crimped over an open upper end 72 of the shell. As a result of this crimping action, the closure 70 includes a peripheral annular ring 74. Included on the closure 70 is an opening 76 for accommodating the reciprocating valve stem 64.

Referring now to FIGS. 3-6, an important feature of the present fuel cell 60 is an adapter, generally designated 80. A main portion of the adapter 80 is the adapter body 82 including a depending ring 84 which is retained on the fuel cell 60 through engagement with the fuel cell closure 70. A tight friction fit of the adapter 80 with the closure 70 is achieved by at least one radially extending gripping formation 86 which tightly engages an interior surface of the peripheral closure ring 74. The gripping formation 86 defines an annular concave recess or groove 88 which accommodates an inner curved portion of the closure ring and preferably is dimensioned for a looser engagement on the closure ring 74 compared to the formation 86, to accommodate manufacturing variations. In addition, an upper end of the gripping formation 86 includes a radially extending lip 89 configured for engaging an upper surface of the closure ring 74. The depending ring 84 and the formation 86 can be provided in a single closed ring or a series of spaced protrusions.

To reduce the possibility of a user accidentally using a fuel cell not suitable for the present tool 10, the adapter 80 is designed to be extremely difficult to remove from the closure 70. This is accomplished by dimensioning the gripping formation 86 and the radially extending lip to have an extremely tight friction fit with the closure 70. In addition, in that the adapter 80 is preferably molded of a plastic material, a material is selected for stiffness, as well as for fuel resistance, moldability and durability. It is contemplated that acetyl, commonly sold under the trademark CELCON® acetyl manufactured by Hoechst Celanese, Charlotte N.C., is a preferred material, however other acetyls, polyamids or other fuel resistant plastics may be suitable.

The other main portion of the adapter 80 is a generally planar, disk-shaped flange 90 that is configured for engaging the locating shelves 52 for suspending the fuel cell 60 in the fuel cell chamber 16. It will be seen that the generally planar flange 90 extends beyond an exterior of the fuel cell outer shell 68. In fact, the flange 90 is dimensioned so that once engaged in the locating shelves 52, it is the sole support for the fuel cell 60 in the fuel cell chamber 16. More specifically, once suspended on the shelves 52, a bottom 92 of the fuel cell 60 is disposed above and free of a floor 94 of the fuel cell chamber 16 (FIG. 3). While the particular engagement of the flange 90 on the shelves 52 is described here, it will be appreciated that the adapter 80 may be provided with alternate structures configured for suspending the fuel cell 60 from the cylinder head 40.

Preferably, the flange 90 has a vertically projecting collar 96. The collar is tubular in shape, defining an inner area 98 that surrounds the valve stem 64. Also, the collar 96 projects from the flange 90 a sufficient distance to protect the valve stem 64 from damage or impact. Another feature of the collar 96 is that it is dimensioned for slidingly accommodating reciprocal movement of a stem receiver block 100. More specifically, an upper end 102 of the collar 96, which extends above an uppermost point of the valve stem 64 when the stem is in its uppermost rest position, also defines an end of an inwardly tapering, annular internal chamfer area 104 that facilitates location of a depending stem engagement portion 106 of the stem receiver block 100 upon the valve stem.

Figure 6:
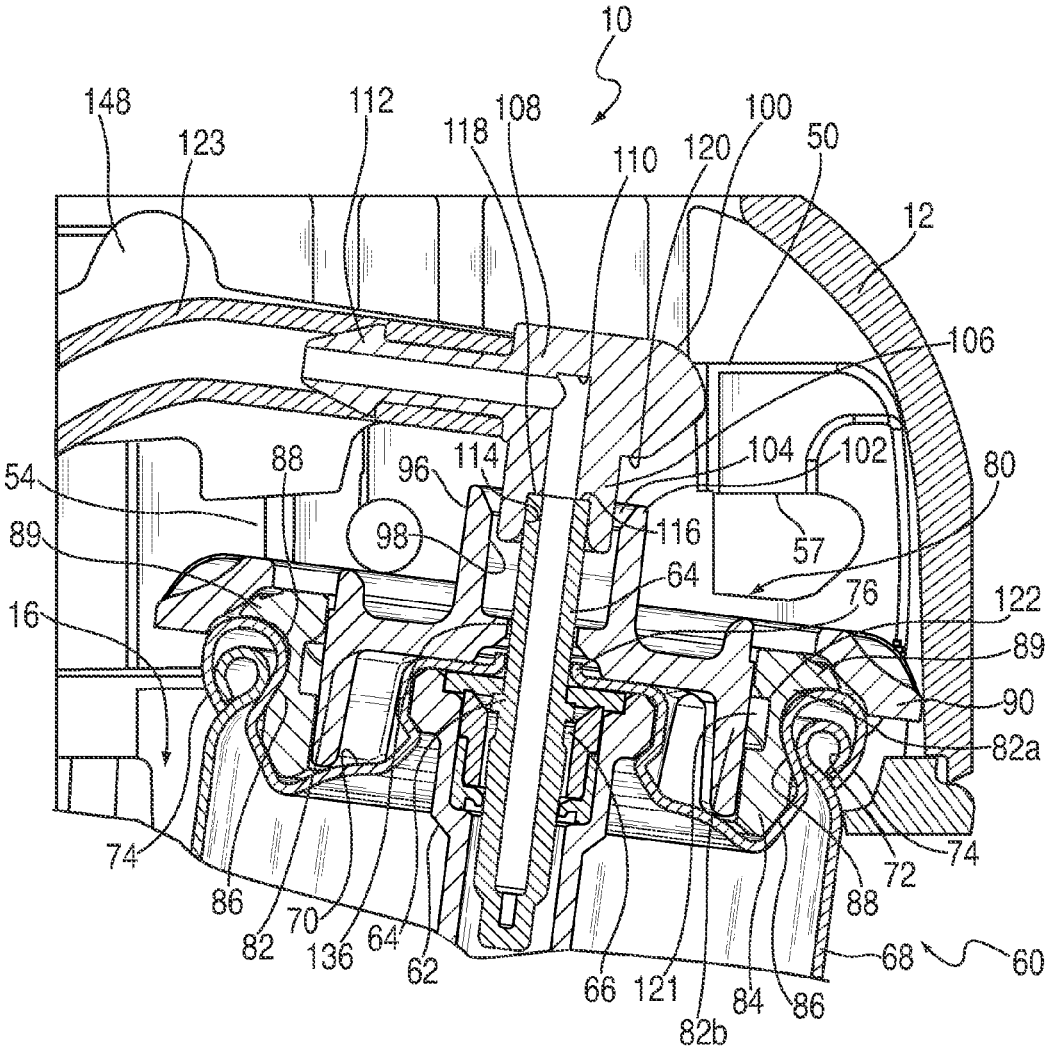
FIG. 6 is an enlarged fragmentary vertical section of the system of FIG. 3.

Referring now to FIGS. 3 and 6, the stem receiver block 100 includes a block-like body 108 defining an internal fuel passage 110 connected at one end to the stem engagement portion 106, and at an opposite end to a fuel port 112, preferably taking the form of a barbed nozzle. Depending from the body 108, the stem engagement portion 106 defines a stem chamber 114 dimensioned to accommodate an upper end 116 of the stem 64. A counterbored stem stop 118 defines an annular flat or horizontal sealing surface for sealingly receiving the upper stem end 116. It has been found that the horizontal stem stop 118 provides a more positive seal with the upper stem end 116 than provided by conventional fuel cell engagement structures.

Another feature of the present stem receiver block 100 is that a shoulder 120 is defined where an underside of the body 108 meets an upper end of the stem engagement portion 106. This shoulder 120 impacts the upper end 102 of the collar 96 to limit the downward movement of the stem receiver block, and accordingly the valve stem 64. In other words, the shoulder 120 is positioned on the body 108 to define a lowermost point of the stroke of the stem receiver block 100 and the valve stem 64. Due to the construction of the internal metering valve 62, the downward travel of the stem receiver block 100 is sufficient to release a dose of fuel from the metering valve.

In the preferred embodiment, the stem receiver block 100 is made of metal, and more preferably aluminum. It has been found that the aluminum is more resistant to flow variations and the resultant dosage variations over a wider range of ambient temperatures resulting in improved performance in lower temperature environments than conventional plastic stem receiver blocks.

Figure 5:
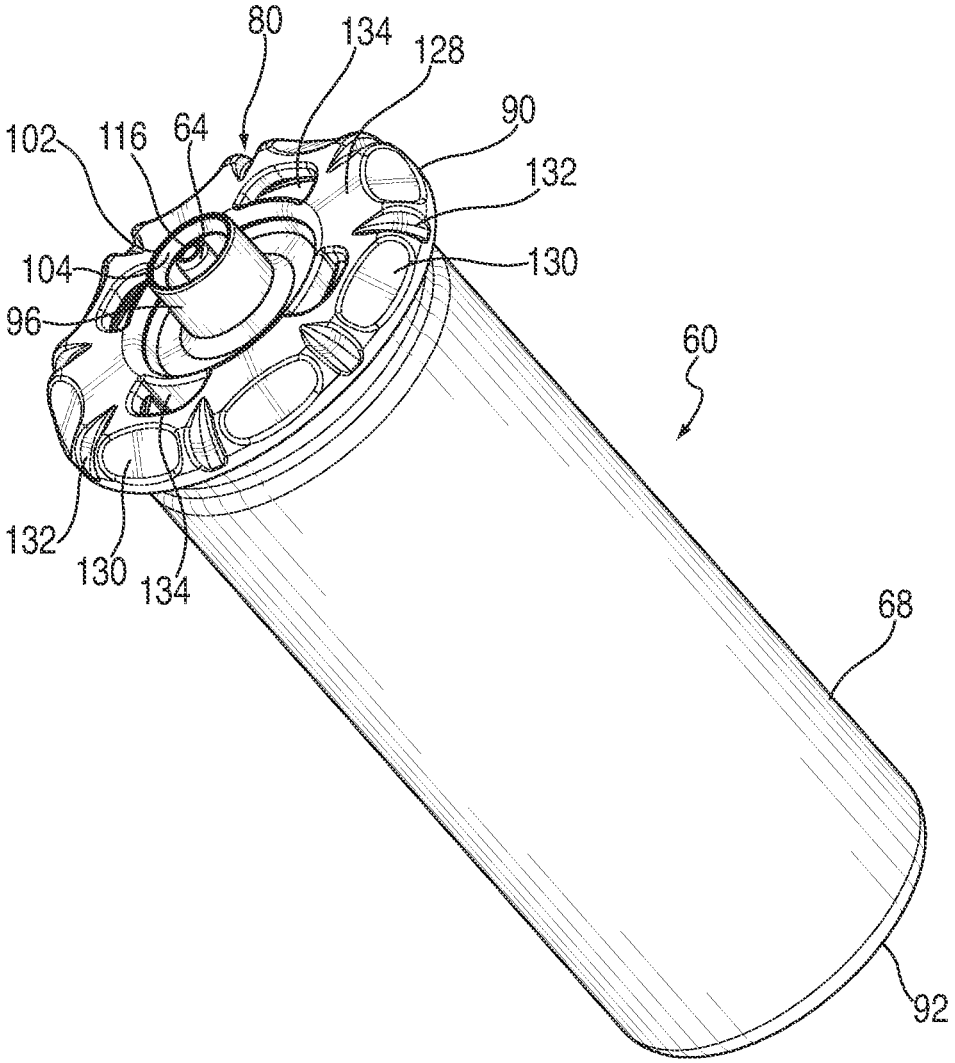
FIG. 5 is a top perspective view of a fuel cell equipped with the present fuel cell adapter.

It is contemplated that the adapter body 82 may be provided in two alternative configurations. In one, as shown in FIGS. 3, 5 and 6, the adapter body 82 has two main components: an outer portion 82*a* including the gripping formation 86, the groove 88 and the lip 89; and an inner portion 82*b*, which includes the collar 96 and the flange 90 and engages the outer portion by a screw-and-twist engagement, where lugs 121 on the inner portion 82*b* engage helical grooves 122 on the outer portion 82*a*. In the other configuration, the adapter body 82 is provided as a single, integral piece.

To complete the connection between the fuel cell valve stem 64 and the combustion chamber 46, a flexible hose or conduit 123 is matingly engaged on the end of the fuel port 112 at one end, and at an opposite end is matingly engaged on a cylinder head inlet fitting 124. Fluid communication between the inlet fitting 124 and the combustion chamber 46 is achieved by a fuel passage 126 in the cylinder head 40.

An advantage of the present adapter 80 is that the combination of the tight frictional engagement between the gripping formation 86 and the radially extending lip 89, the suspension of the fuel cell 60 in the tool using the flange 90 engaging the shelves 52, and the direct engagement of the stem receiver block 100 upon the fuel cell has been found to significantly improve fuel cell efficiency. More specifically, a more consistent fuel dosing is obtained, and performance in colder temperatures has been improved.

Referring now to FIG. 5, an upper surface 128 of the flange 90 is preferably provided with integrally formed depressions 130 and grooves 132 for enhancing gripping and handling by a user. This enhanced gripping is useful when the adapter 80 is provided in two portions 82*a*, 82*b* as described above. In addition, openings 134 are provided for facilitating molding. The specific shapes and dimensions of the depressions 130, the grooves 132 and the openings 134 may vary to suit the particular application, and in some cases may be optionally eliminated.

Referring again to FIGS. 3 and 6, another feature of the present adapter 80 is that the flange 90 defines a stem opening 136 for reciprocally and slidingly accommodating the valve stem 64. It is preferred that the stem opening 136 is dimensioned for defining a tight, sliding engagement with the valve stem such that there is minimal clearance between the opening and the valve stem outer surface. Such tight, sliding engagement reduces the chances for dirt to become lodged in the fuel cell metering valve 62. In addition, the relatively small diameter opening 136 prevents the adapter 80 from being used with incompatible fuel cells, which have larger diameter stems that will not fit through the opening 136. As is known in the art, there are different fuel cell fuel mixtures, and some mixtures are formulated for specific types of tools, and will be less effective if used with incompatible tools.

Referring now to FIGS. 2 and 3, as is known in the art, to dispense a dose of fuel from the fuel cell 60 through the flexible hose 122, a fuel cell actuator assembly is provided and is generally designated 138 which is in operational relationship with fuel cell chamber 16 and is constructed and arranged for exerting an axial force on the valve stem 64. A main component of the actuator 138 is a generally elongate actuator element 140 configured for exerting an axial force on the stem 64, releasing the dose of fuel. In the preferred embodiment, the element 140 is associated with the fuel cell door 18 and is in actual contact with the stem receiver block 100.

As seen in FIGS. 2 and 3, the fuel cell door 18 is pivotally engaged with the pivot points 57 on the cylinder head arms 50. As is well known in the combustion tool art, vertical projections 142 on the reciprocating valve sleeve 144 (which largely defines the combustion chamber 46) engage ends 146 of the actuator element 140 and cause it to rock relative to the fuel cell door 18, thus exerting the periodic axial force on the stem receiver block 100, which in turn axially depresses the valve stem 64. Also shown in FIG. 2 is the pivoting nature of the stem receiver block 100, which is connected to a pivoting arm 148 connected to the cylinder head 40 at points 150. Once the tool 10 is pressed against a workpiece, the workpiece contact element 32 is retracted relative to the cylinder 24, ultimately causing the depression of the valve stem 64, releasing a dose of fuel into the combustion chamber 46 and a resulting combustion or firing of the tool 10.

While a particular embodiment of the present interface for a fuel delivery system for a combustion nailer has been shown and described, it will be appreciated by those skilled in the art that changes and modifications may be made thereto without departing from the invention in its broader aspects and as set forth in the following claims.

What is claimed is:

1. A fuel delivery system constructed and arranged for use with a combustion nailer including a cylinder head frame, and a combustion chamber, said fuel delivery system comprising:

a fuel cell with an outer shell having a closed lower end and an open upper end;

a closure crimped over said upper end and defining an opening for accommodating a reciprocating valve stem;

a fuel cell adapter frictionally engaging said closure and including a flange having a diameter greater than a diameter of said fuel cell outer shell and being configured for suspending said fuel cell in said fuel cell chamber;

a stem receiver block connectable to the cylinder head frame and including a stem engagement portion configured for directly and sealingly engaging an end of said valve stem, said stem engagement portion being in fluid communication with an internal receiver passage constructed and arranged for delivering fuel to the combustion chamber; and said fuel cell adapter includes a vertically projecting collar projecting normally from said flange and dimensioned for slidingly accommodating reciprocal movement of said stem engagement portion and configured for protecting said valve stem against breakage.

2. The fuel delivery system of claim 1, wherein said stem receiver block includes a body defining said internal fuel passage, and said stem engagement portion depends from said body and defines a stem chamber.

3. The fuel delivery system of claim 2, wherein said stem chamber includes a stem stop defining a generally horizontal surface configured for engaging an upper end of a fuel cell stem.

4. The fuel delivery system of claim 2 wherein said body includes a port for engaging a flexible fuel line for connection to the tool combustion chamber.

5. The fuel delivery system of claim 1 wherein said collar has an upper end extending above an upper stem end when said stem is in a rest position.

6. The fuel delivery system of claim 1 wherein said collar includes a radially inwardly tapering internal chamfer for facilitating location of a depending, stem engagement portion of said stem receiver block upon the valve stem.

7. The fuel delivery system of claim 1 wherein said collar is dimensioned for defining a stroke of the stem receiver block and the fuel cell stem.

8. The fuel delivery system of claim 1 wherein said flange defines an opening for accommodating said stem, said opening being dimensioned for defining a tight, sliding engagement with said stem and for preventing use of said adapter with incompatible fuel cells.

9. The fuel delivery system of claim 1, wherein said stem receiver block includes a body having said internal fuel passage and a depending stem engagement portion, and said adapter includes a vertically projecting collar for slidably engaging said a depending stem engagement portion of said stem receiver block, said body configured for engaging an upper end of said collar for defining a lowermost point of travel of said body and said fuel cell stem.

10. The fuel delivery system of claim 1 wherein said stem receiver block is made of metal.

11. The fuel delivery system of claim 1, wherein said fuel cell adapter includes a gripping formation configured for tightly engaging a peripheral ring of the fuel cell, said gripping formation defines an annular concave recess or groove which accommodates an inner curved portion of the closure ring, and an upper end of the gripping formation includes a radially extending lip configured for engaging an upper surface of the closure ring.

12. The fuel cell delivery system of claim 1 wherein said flange has an upper surface provided with at least one of integrally formed depressions and grooves for enhancing gripping and handling by a user.

13. The fuel delivery system of claim 1 wherein said collar defines a diameter less than half a diameter of said flange.

14. A fuel delivery system constructed and arranged for use with a combustion nailer including a cylinder head frame and a combustion chamber, said fuel delivery system comprising:

a fuel cell with an outer shell having a closed lower end and an open upper end;

a closure crimped over said upper end and defining an opening for accommodating a reciprocating valve stem;

a fuel cell adapter frictionally engaging said closure and including a flange having a diameter greater than a diameter of said fuel cell outer shell and being configured for suspending said fuel cell in said fuel cell chamber;

said flange having an upper surface provided with at least one of integrally formed depressions and grooves for enhancing gripping and handling by a user;

said fuel cell adapter includes a vertically projecting collar projecting normally from said flange and dimensioned for slidingly accommodating reciprocal movement of said stem engagement portion and configured for protecting said valve stem against breakage; and a stem receiver block connectable to the cylinder head frame and including a stem engagement portion configured for sealingly engaging an end of said valve stem, said stem engagement portion being in fluid communication with an internal receiver passage constructed and arranged for delivering fuel to the combustion chamber, said stem receiver block being made of metal.

15. A fuel delivery system constructed and arranged for use with a combustion nailer including a cylinder head frame, and a combustion chamber, said fuel delivery system comprising:

a fuel cell with an outer shell having a closed lower end and an open upper end;

a closure crimped over said upper end and defining an opening for accommodating a reciprocating valve stem;

a fuel cell adapter frictionally engaging said closure and including a flange having a diameter greater than a diameter of said fuel cell outer shell and being configured for suspending said fuel cell in said fuel cell chamber;

a stem receiver block made of metal for enhancing fuel vaporization that improves tool performance in cool weather, said block being connectable to the cylinder head frame and including a stem engagement portion configured for directly and sealingly engaging an end of said valve stem, said stem engagement portion being in fluid communication with an internal receiver passage constructed and arranged for delivering fuel to the combustion chamber; and said fuel cell adapter includes a vertically projecting collar projecting normally from said flange and dimensioned for slidingly accommodating reciprocal movement of said stem engagement portion and configured for protecting said valve stem against breakage.

* * * * *